United States Patent [19]

Fey

[11] Patent Number: 4,483,410

[45] Date of Patent: Nov. 20, 1984

[54] CENTRAL LOCKING SYSTEM

[75] Inventor: Rainer Fey, Schweinfurt, Fed. Rep. of Germany

[73] Assignee: Fichtel & Sachs AG, Schweinfurt, Fed. Rep. of Germany

[21] Appl. No.: 461,950

[22] Filed: Jan. 28, 1983

[30] Foreign Application Priority Data

Feb. 13, 1982 [DE] Fed. Rep. of Germany ..... 3205166

[51] Int. Cl.[3] ..... E05B 63/00

[52] U.S. Cl. ..... 180/281; 70/465; 180/282

[58] Field of Search ..... 180/281, 282, 271; 70/465, 238, 239, 256, 257

[56] References Cited

FOREIGN PATENT DOCUMENTS 27747 4/1981 European Pat. Off. .
2757246 12/1977 Fed. Rep. of Germany .
57720 5/1979 Japan .

*Primary Examiner*—David M. Mitchell
*Assistant Examiner*—Ross Weaver
*Attorney, Agent, or Firm*—Toren, McGeady and Stanger

[57] ABSTRACT

The central locking system for motor vehicles comprises a plurality of electric locking drives 1 and a time control means 15 which can be triggered by at least one manually switchable control switch 25 in the setting of a switch position allocated to the unlocking direction. The time control means switches on the locking drives 1 for a predetermined time duration in the unlocking direction. In parallel with the contacts 23, 27 of the control switch 25 which are allocated to the unlocking direction there is connected an electronic short-circuit switch 31, 33 which together with the control switch automatically holds the short-circuit switch position and is switchable into its short-circuit position by means of an acceleration switch 28 responding to its acceleration.

7 Claims, 1 Drawing Figure

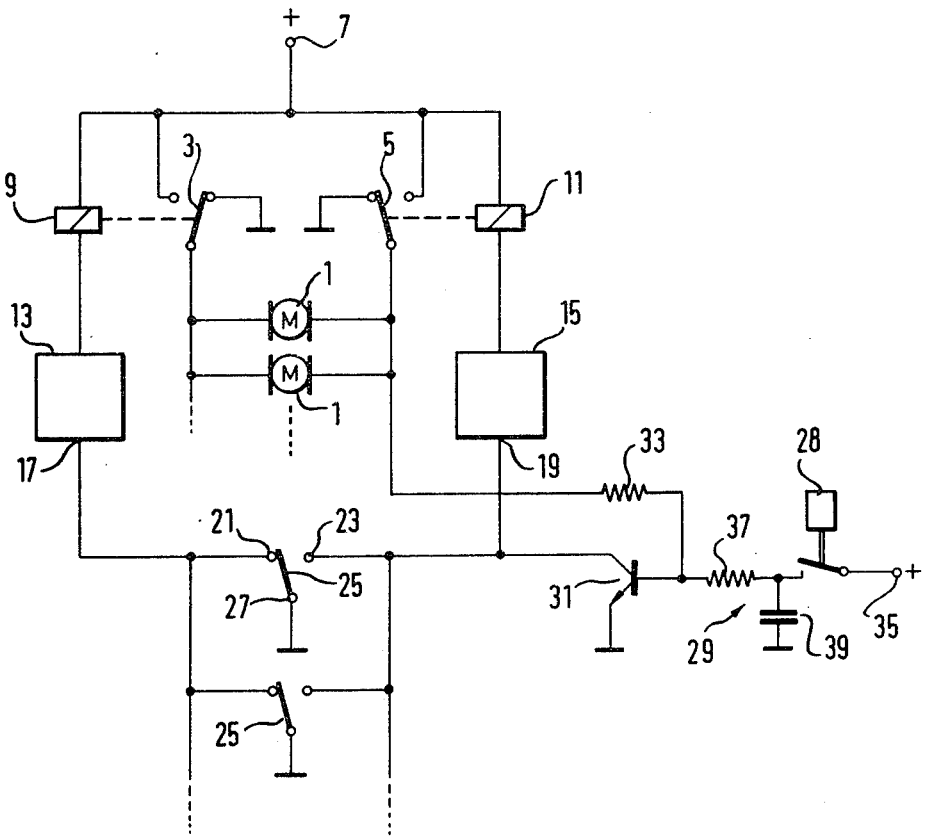
+
7
3
5
9
11
1
M
M
1
13
15
17
19
33
28
21
23
37
25
27
31
29
39
35
+
25

CENTRAL LOCKING SYSTEM

BACKGROUND OF THE INVENTION

The present invention relates to a central locking system for motor vehicles and more particularly to a central locking system comprising a plurality of electric locking drives and a time control means which can be triggered by at least one manually switchable control switch on setting of a predetermined switch position, wherein the time control means switches on the locking drives for a predetermined time duration in a drive direction allocated to the predetermined switch position.

Central locking installations of this kind are known, for example from German Publication Specification No. 27 57 246. In each case a single current pulse is fed to the locking drives, which is triggered by means of the control switch and is so dimensioned in time that the locking drives are switched on for a time period sufficient either for locking or for unlocking.

Now it is sought to ensure, in central locking systems of this kind, by means of acceleration switches or the like, that in the case of an accident the central locking system is automatically controlled into its unlocking position so that helpers can enter the vehicle, even if the installation was previously locked. These attempts have shown that especially when delicate acceleration switches are used, the time control means was very frequently triggered for example when running over potholes, which led to damage to the electronics due to overloading.

The invention is directed toward improving the central locking system so that its time control means is triggered, in the case of multiple successive actuations of an acceleration switch, only on the first actuation in each case.

SUMMARY OF THE INVENTION

Briefly, the present invention may be described as a central locking system for motor vehicles having a plurality of electric locking drives and a time control means which can be triggered by at least one manually switchable control switch on setting of a predetermined switch position. The time control means switches on the locking drives for a predetermined time duration in a drive direction allocated to the predetermined switch position. In parallel with the contacts of the control switch which are connected with one another on switching on of the locking drives in the unlocking direction, there is connected an electronic short-circuit switch which is switchable into its short-circuit position by means of an acceleration switch responding to its acceleration. The parallel connection of the two switches has short-circuit self-holding function.

On the first actuation of the acceleration switch the short-circuit switch short-circuits the control switch at least until the control switch too closes. The parallel connection of the two switches remains short-circuited until the central locking system is controlled again into the locking position by manual actuation of the control switch. As long as the parallel connection of the switches is closed, the acceleration switch remains ineffective.

In a preferred embodiment of the invention the short-circuit switch comprises a switch transistor the collector-emitter path of which is connected in parallel with the contacts of the control switch, while the time control means controls the short-circuit switch into the short-circuit position at least during the period during which the locking drives are switched on in the unlocking direction. Such an embodiment is constructionally simple and improves the operational reliability of the central locking system as a whole. The triggering behaviour and the time-constant behaviour of the time control means depend not least upon the switching behaviour of the control switch, especially upon its contact resistances and lead resistances. The switch transistor working in parallel with the control switch in short-circuit operation ensures constant and defined impedance properties at the control input of the time control means. The input resistance of the time control means can in this way be made of lower impedance, so that the sensitivity especially to moisture decreases.

The base of the switch transistor is preferably coupled to a pole-reversing circuit controlled by the time control means in dependence upon the switch position of the control switch for the reversal of the direction of drive of the locking drives. In such a circuit arrangement the switch transistor opens and closes in dependence upon the position of the control switch.

The base of the switch transistor is expediently coupled to a capacitor the voltage of which controls the switch condition of the switch transistor, while the acceleration switch is connected into a charging circuit of the capacitor. In this way the switch transistor can be switched into its self-holding condition short-circuiting the control switch even if the acceleration switch was actuated only during a time interval which in itself would not be sufficient for the tripping of the time control means. During this short time period the capacitor is charged up and switches through the switch transistor until the time control means holds this condition.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWING

In the drawing the FIGURE shows a block circuit, diagram of a central locking system which is controllable into its unlocking condition by means of an acceleration switch.

DESCRIPTION OF THE PREFERRED EMBODIMENT

The central locking system for a motor vehicle comprises a plurality of locking drive means (not illustrated further) which can lock or unlock the locks of the motor vehicle doors or of the boot or the like. The locking drives are driven by electric motors 1 of reversible direction of rotation which are connected in parallel with one another to a pole-reversing circuit formed from two relay change-over contacts 3 and 5. The pole-reversing circuit connects the motors 1, pole-reversibly, with an operating voltage terminal 7 and ground. The relay change-over contacts 3 and 5 belong to separate relays 9 and 11, the energising current of which is controlled by separate time control circuits 13 and 15. The fixed contacts 21 and 23 of one or more parallel-connected control change-over switches 25, the movable contact 27 of which is connected to ground, are connected to control inputs 17 and 19 of the time control circuits 13, 15. The control change-over switches 25 are manually actuatable and alternately trigger either the time control circuit 13 or the time control circuit 15. Each of the time control circuits 13, 15, when its control input 17 or 19 is connected to ground through one of the control change-over switches 25, delivers an energising current pulse to the associated relay 9 or 11 which switches the associated relay switch-over contact 3 or 5 out of its position normally connected to ground into a position connected with the operating voltage terminal 7. Each of the control change-over switches 25 is moreover positively coupled mechanically with one of the locking drives and is switched over by the locking drives into the position allocated to the drive direction. If one of the control switches 25 is actuated manually, through the time control circuit 13 or 15 it switches on all the locking drives which readjust all the other control change-over switches in conformity with the control change-over switch which has been shifted manually.

In the embodiment as illustrated the locking drives are switched on in the locking direction through the time control circuit 13, while the time control circuit 15 controls the unlocking direction. The time control circuit 15 can be triggered not only by way of the control change-over switches 25, but also by way of an acceleration switch (crash sensor) 28 responding to its acceleration, so that the central locking system is automatically unlocked and gives access to the interior of the vehicle in the case of a motor vehicle accident. Through a time member 29 the acceleration switch 28 controls a switch transistor 31 the collector-emitter path of which is connected parallel to the contacts 23, 27 of the control change-over switches 25 which control the time control circuits. The base of the switch transistor 31 is connected through a base series resistor 33 with the relay contact 5 of the pole-reversing circuit. The switch transistor 31 can thus simulate the function of the control switch 25 and trigger the time control circuit 15.

The switch transistor 31 remains switched through as long as the relay 11 is energised through the time stage 15 and the relay switch-over contact 5 connects the base of the switch transistor 31 with the operating voltage terminal 7. At the same time the locking drives are switched on in the unlocking direction and the control change-over switches are switched over from the switch position as represented in the FIGURE, in which they trigger the locking operation, into the position allocated to the unlocking direction. If subsequently the acceleration switch 28 is tripped afresh, this has no influence upon the time control circuit 15. The switch transistor 31 merely forms an additional short-circuit to the already short-circuited contacts 23, 27 of the control changeover switches.

The time member 29 merely lengthens the possibly briefly occurring switch signals of the acceleration switch 28 in order to ensure that the relay 11 can respond. The time constant of the time member 29 can therefore be made short and has to amount to only a few milliseconds. The time member 29 comprises a resistor 37 connected in series with the acceleration switch 28 between an operating voltage terminal 35 and the base of the switch transistor 31, and a capacitor 39 connected between the connection point of the acceleration switch 28 and the resistor 37 and leading to ground. During the short actuation duration of the acceleration switch 28 the capacitor 39 is charged up to a voltage blocking the switch transistor.

The circuit arrangement as explained above is unlocked in dependence upon acceleration as follows:

On actuation of the acceleration switch 28 the switch transistor 31 is switched through by way of the time member 29 and triggers the time control circuit 15. The relay 11 pulls up, whereby the base of the switch transistor 31 is connected through the resistor 33 and the relay switch-over contact 5 with the operating voltage terminal 7. The switch transistor 31 remains switched through during the energisation time of the relay 11. At the same time the relay switch-over contact 5 switches on the locking drives in the unlocking direction, the control change-over switches 25 being switched over into the switch position corresponding to the unlocking direction, in which the contacts 23 and 27 are connected with one another. Further control pulses triggered by the acceleration switch remain ineffective.

While a specific embodiment of the invention has been shown and described in detail to illustrate the application of the inventive principles, it will be understood that the invention may be embodied otherwise without departing from such principles.

What is claimed is:

1. A central locking system for motor vehicles comprising:

a plurality of electric locking drives;

at least one manually switchable control switch having contacts which are connected with one another on switching on of said locking drives in an unlocking direction;

a time control means which can be triggered by said control switch on setting of a predetermined switch position, said time control means being arranged for switching on the locking drives for a predetermined time duration in a drive direction allocated to said predetermined switch position;

an acceleration switch for responding to its acceleration;

an electronic short-circuit switch connected in parallel with said contacts of said control switch and being switchable into its short-circuit position by means of said acceleration switch; and holding means for preventing repeated operation of said locking drives in response to repeated operation of said acceleration switch, said holding means including a latch circuit for maintaining the short circuit switch in the short circuit condition.

2. Central locking system according to claim 1, characterized in that the short-circuit switch comprises a switch transistor having a collector-emitter path connected in parallel with said contacts of said control switch and in that said time control means being arranged to controls said short-circuit switch into said short-circuit position during the period during which the locking drives are switched on in said unlocking direction.

3. Central locking system according to claim 2, wherein said switch transistor comprises a base coupled to a pole-reversing circuit controlled by said time control means in dependence upon the switch position of said control switch, for the reversal of the direction of drive of said locking drives.

4. Central locking system according to claim 2, wherein said switch transistor comprises a base coupled to a capacitor the voltage of which control the switch condition of said switch transistor and wherein said acceleration switch is connected into a charging current circuit of said capacitor.

5. A system as in claim 1, wherein said latch circuit is coupled to said time control switch means for maintaining the short circuit switch in the short circuit condition while said time control means switches one of the locking drives for the predetermined time.

6. A central locking system for a motor vehicle, comprising:

drive means for driving the locks into locking and unlocking positions;

first time switching means for switching the drive means to drive the locks in a locking direction for a predetermined time;

second switching means for switching said drive means to drive the locks in the unlocking direction for a predetermined time;

manually operable selector means for forming one of two circuit paths to activate the first switching means when the first circuit path is formed and to actuate the second switch means where the second circuit path is formed;

override means connected across the second circuit path for activating the second switching means when energized;

inertial means for energizing said override means, and latch means coupled to said second switching means for continuously energizing said override means while said drive means drives the lock in the unlocking direction for the predetermined time.

7. A system as in claim 6, wherein said switching means includes a switch for connecting said drive means to a source during the predetermined time, said latch means being connected to the switch to apply the source to said override means.

* * * * *